US012515120B2

(12) United States Patent
Bergant et al.

(10) Patent No.: US 12,515,120 B2
(45) Date of Patent: Jan. 6, 2026

(54) ROULETTE SYSTEM WITH SIDE BETS BASED ON DIFFERENT BALLS

(71) Applicant: INTERBLOCK D.O.O., Menges (SI)

(72) Inventors: Urban Bergant, Kamnik (SI); Ivo Zavbi, Kamnik (SI); Peter Kroselj, Kamnik (SI)

(73) Assignee: INTERBLOCK D.O.O., Menges (SI)

( * ) Notice: Subject to any disclaimer, the term of this patent is extended or adjusted under 35 U.S.C. 154(b) by 981 days.

(21) Appl. No.: 17/685,199

(22) Filed: Mar. 2, 2022

(65) Prior Publication Data

US 2022/0184486 A1 Jun. 16, 2022

Related U.S. Application Data

(63) Continuation of application No. 17/063,581, filed on Oct. 5, 2020, now abandoned.

(60) Provisional application No. 62/913,120, filed on Oct. 9, 2019.

(51) Int. Cl.
*A63F 5/00* (2006.01)

(52) U.S. Cl.
CPC ..... *A63F 5/007* (2013.01)

(58) Field of Classification Search
CPC ..... A63F 5/00; A63F 5/0005; A63F 5/0088
USPC ..... 273/142 H, 142 E, 142 F, 142 G, 143 R, 273/143 A
See application file for complete search history.

(56) References Cited

U.S. PATENT DOCUMENTS 5,042,810 A 8/1991 Williams
5,718,431 A 2/1998 Ornstein
5,743,798 A 4/1998 Adams et al.
5,743,800 A 4/1998 Huard et al.
5,755,440 A 5/1998 Sher
6,152,448 A * 11/2000 Cudlipp ..... A63F 5/04 273/144 R
7,669,850 B1 3/2010 Miller
8,177,234 B2 5/2012 Nicely et al.
9,327,186 B1 * 5/2016 Pececnik ..... A63F 5/0088
11,551,530 B2 * 1/2023 Brikho ..... A63F 5/0088
2003/0094752 A1 5/2003 Mathews et al.
2005/0003885 A1 1/2005 Rhoten et al.

(Continued)

OTHER PUBLICATIONS

International Patent Application No. PCT/US2020/054433; Int'l Search Report and the Written Opinion; dated Dec. 31, 2020; 11 pages.

(Continued)

*Primary Examiner* — Joseph B Baldori
(74) *Attorney, Agent, or Firm* — BakerHostetler

(57) ABSTRACT

A wagering system including a roulette wheel, multiple balls of a first or second color, a selector for selecting a ball, and a processor that causes the system to randomly select a ball for use in the game which is determined when the selected roulette ball stops at a numbered wheel position, selects one or more side bet numbers when a side bet is placed by a player, and resolves side bet wagers as follows: side bet wagers are forfeit when a first colored ball is selected or paid at lower odds; side bet wager may be forfeit when either ball is selected and the number position on the roulette wheel does not match the side bet number; and side bet wagers are resolved at higher odds when the second colored ball is the selected roulette ball and the number position on the roulette wheel matches the side bet number.

11 Claims, 5 Drawing Sheets

(56) References Cited

U.S. PATENT DOCUMENTS

| | | | |
|---|---|---|---|
| 2005/0192076 | A1 | 9/2005 | Lowery |
| 2006/0237905 | A1 | 10/2006 | Nicely et al. |
| 2007/0246883 | A1 | 10/2007 | Cudlipp |
| 2008/0132315 | A1 | 6/2008 | Fisher et al. |
| 2009/0283967 | A1 | 11/2009 | Stergides |
| 2010/0227665 | A1 | 9/2010 | Nicely |
| 2011/0059785 | A1 | 3/2011 | Scalisi |
| 2012/0153571 | A1 | 6/2012 | Smith et al. |
| 2013/0316799 | A1 | 11/2013 | Hsu et al. |
| 2015/0087377 | A1 | 3/2015 | Yee et al. |
| 2015/0279165 | A1 | 10/2015 | Kock |
| 2016/0012684 | A1 | 1/2016 | Zielinski et al. |
| 2016/0071352 | A1 | 3/2016 | Jackson |
| 2016/0328905 | A1 | 11/2016 | Kohl et al. |

OTHER PUBLICATIONS

Booker; "Gambling on the Roulette Lucky Ball Side Bet in Las Vegas"; https://www.bestuscasinos.org/blog/gambling-on-the-roulette-lucky-ball-side-bet-in-las-vegas/; Jul. 2020; accessed Dec. 1, 2020; 9 pages.

International Patent Application No. PCT/US2020/054433; Int'l Preliminary Report on Patentability; dated Apr. 21, 2022; 10 pages.

* cited by examiner

ROULETTE SYSTEM WITH SIDE BETS BASED ON DIFFERENT BALLS

CROSS REFERENCE TO RELATED APPLICATIONS

This application is a continuation of U.S. patent application Ser. No. 17/063,581, filed Oct. 5, 2020; which claims benefit under 35 U.S.C. § 119(e) of Provisional U.S. Patent Application No. 62/913,120, filed Oct. 9, 2019, the contents of each of which are incorporated herein by reference in their entirety.

BACKGROUND OF THE INVENTION

Field of the Invention

The present invention relates to the field of gaming, particularly roulette gaming and the use of side bets enabling novel gaming methods.

Background of the Art

Roulette is a popular wagering game played in casinos and other gaming establishments. Avid players are generally open to, and sometimes specifically seek out, new and more interesting ways to play roulette, particularly when the reward for a winning outcome at the end of a round of play, or the odds of achieving a winning outcome, may be enhanced.

U.S. Pat. No. 9,327,186 discloses a roulette-based wagering system including drop balls of different colors, the disclosure of which is incorporated herein by reference.

All disclosures cited herein are incorporated in their entirety. Further advances in roulette gaming technology are still desired within the industry.

SUMMARY OF THE INVENTION

Illustrative examples of the disclosure include, without limitation, methods, systems, and various devices. A roulette-based wagering system includes: a physical roulette wheel; a source of multiple balls including at least two balls of different colors; a selection system that selects a single ball from a roulette ball storage area for use in a roulette wagering event; a processor having a random number generator; and a display system. The processor may be configured to control most aspects of the roulette-based wagering event, including randomly selecting for the next wagering event one ball to be spun of either a first color or a second color. The wagering event proceeds according to standard roulette play with standard roulette odds unless a side bet wager is placed based on the first color ball and/or the second color ball. The processor is configured to recognize side bet wagers placed and to resolve placed wagers as follows:

A wagering system including a roulette wheel, multiple balls of a first or second color, a selector for selecting a ball, and a processor that causes the system to randomly select a ball for use in the game which is determined when the selected roulette ball stops at a numbered wheel position, selects one or more side bet numbers when a side bet is placed by a player, and resolves side bet wagers as follows: side bet wagers are forfeit when a first colored ball is selected or paid at lower odds; side bet wager may be forfeit when either ball is selected and the number position on the roulette wheel does not match the side bet number; and side bet wagers are resolved at higher odds when the second colored ball is the selected roulette ball and the number position on the roulette wheel matches the side bet number.

Other features of the systems and methods are described below. The features, functions, and advantages can be achieved independently in various examples or may be combined in yet other examples, further details of which can be seen with reference to the following description and drawings.

DETAILED DESCRIPTION

Figure 1:
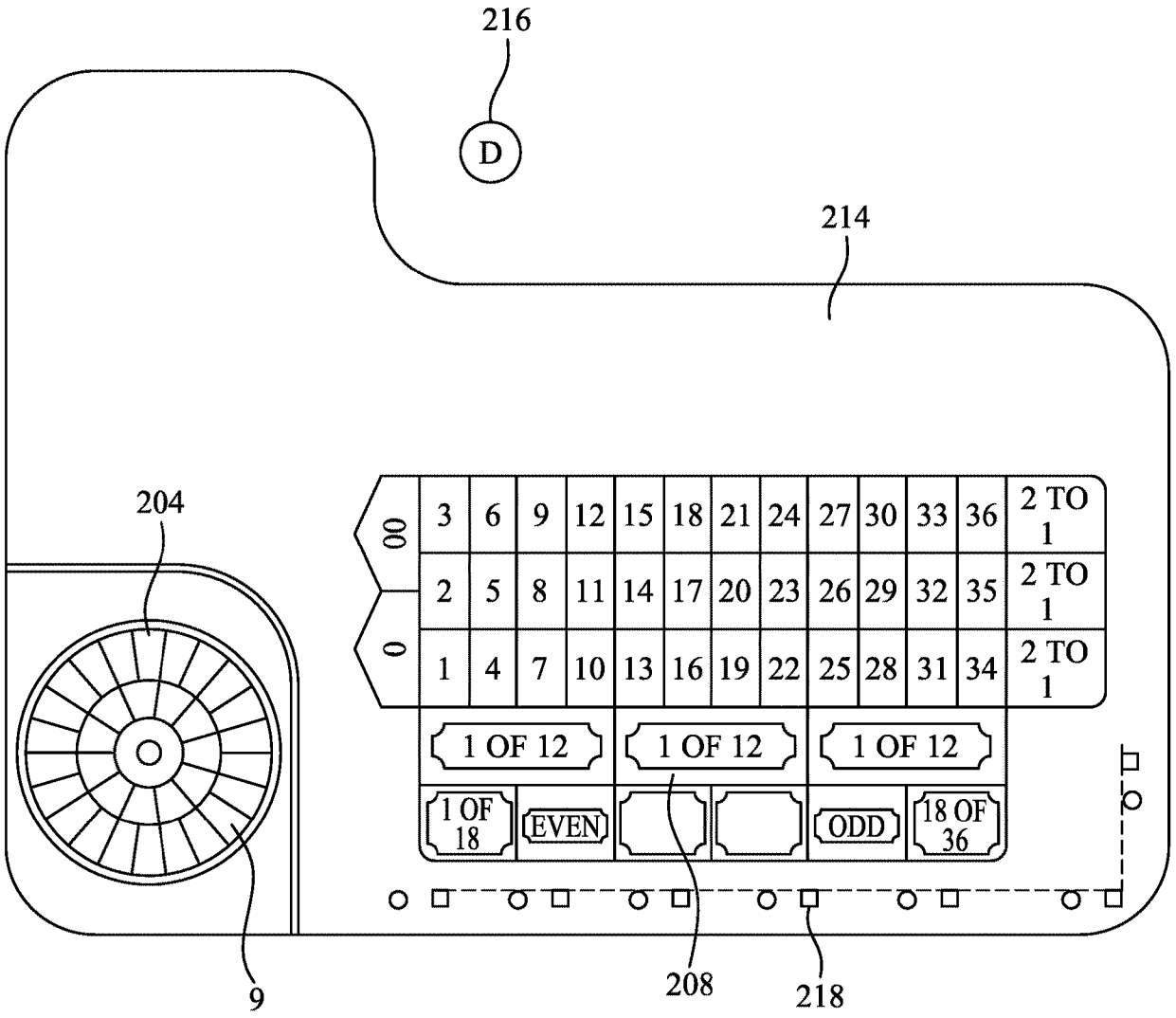
FIG. 1 is an illustration of a standard roulette table with standard wagering information and positions.

FIG. 1 illustrates a standard roulette table with standard wagering information and positions that may be used in the practice of the underlying play of the present disclosure. The table includes a wheel 204 and a conventional betting layout 208 (also known as a register, board or chart) on a table felt 214. The dealer is located at position 216, and the players take positions across the table from the dealer in front of slots 218. The wagering layouts 208 are conventionally placed on the felt 214 by a screen printing method.

A player may occupy one of a number of player positions (typically 7-positions) at the roulette table. The table also has a number of mutually distinctive sets of chips equal to the maximum number of player positions with each chip having the same value. Each player is assigned a different one of the sets as a source of chips and may bet the chips on one or more numbers on the conventional betting layout 208. Thus, in one form, each one of the mutually distinctive sets of chips has both value chips and non-value chips. Each player in this embodiment may use value chips to bet on one or more numbers on the conventional betting layout.

A game or wagering event typically starts once any bets from a prior game or event has been settled and players are instructed to place their bets for the new game or event. As bets are being placed, the wheel 204 may be spun in a first rotational direction and a ball (not shown in FIG. 1) may be spun in a track positioned in an upper outer portion of the wheel 204 in an opposite direction. The ball will eventually lose momentum in the track causing the ball to fall out of the track and bounce around a lower interior portion of the wheel. The wheel 204 has a number of slots formed in the lower interior portion, each containing a number matching the numbers 0, 00 and 1-36 on the layout 208. The wheel 204 may also include a number of protrusions in the lower interior portion that cause the ball to bounce in an unpredictable manner once the ball enters the lower interior portion. Players typically may continue to place bets until the ball exists the track, at which point the wagering is closed. The game or event concludes when the ball settles in a numbered slot and all wagers placed during the game or event are resolved. If a player has placed a bet on a particular number and the ball settles in a numbered slot that matches that particular number, the player wins the bet and is paid some multiple of the amount bet. If the ball settles in a numbered slot that does not match that particular number, the bet may be lost. The typical game or event includes additional ways in which a bet may be won or lost, but those are not relevant to the present disclosure.

In an embodiment of the present disclosure, an electromechanical system may start, rotate and stop the wheel 204 and spin the ball in place of a human dealer. The other portions of the table and layout 208 may be operated by a human with players placing physical chips on the table for each game or event. A plurality of balls may be stored in a storage area under the table, with a different ball selected for each game. When a ball has settled in a numbered slot and all wagers have been resolved, the slot may include a trap door that opens so the ball may fall below the table surface and be returned to the storage area. At the same time, the system may have already selected the next ball to be spun so as to increase the pace of play. The ball may be spun by a variety of electromechanical systems, including a blower. The ball to be spun may be placed in a tube out of sight of players until air is suddenly blown behind the ball by the blower causing the ball to exit the tube and enter the track of the wheel 204. Typically, all of the balls are the same color, usually white.

Figure 2:
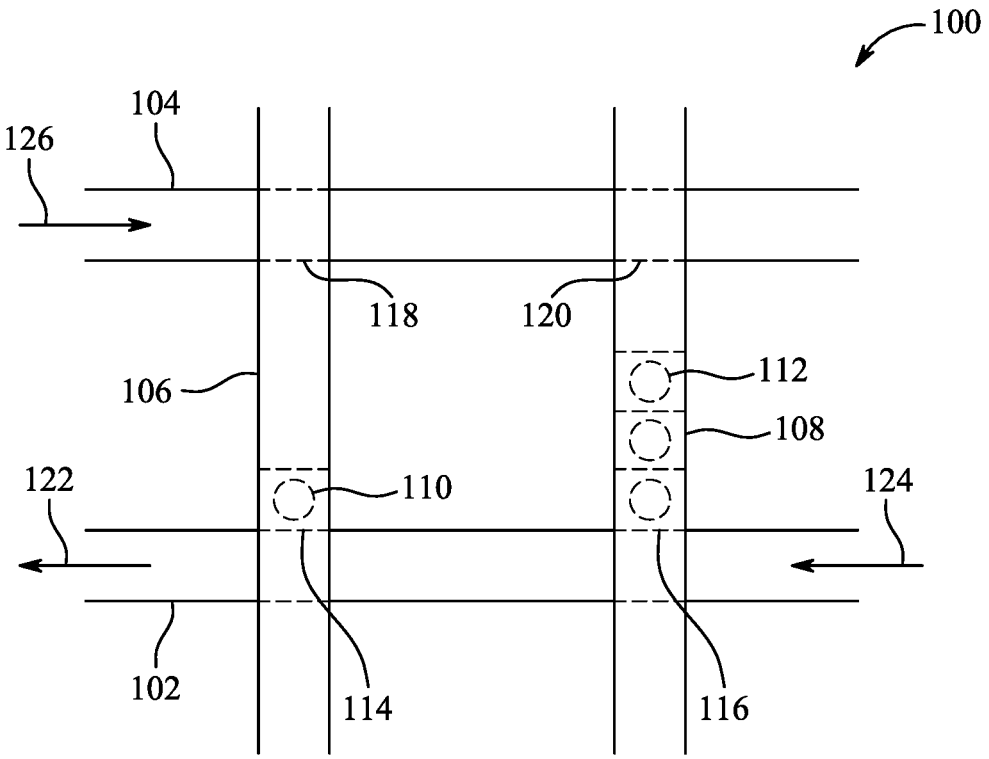
FIG. 2 is an illustration of a side view of the available balls for selection in a ball storage area.

FIG. 2 is a representation of a side view of the available balls for selection in a ball storage area 100 that may include a number of tubes and racks. A ball delivery tube 102 may carry balls from the storage area 100 to the blower and a ball return tube 104 may carry balls from the trap door of the wheel 204 to the storage area 100. A bonus ball storage column or rack 106 may store balls of a first color 110 and standard ball storage column or rack 108 may store balls of a second color 112. Open/close elements 114 and 118 may control the release and storage, respectively, of the first colored balls 110 from and to rack 106, while open/close elements 116 and 120 may control the release and storage, respectively, of the second colored balls 112 from and to rack 108. The elements 114, 118, 116 and 120 may be electromechanical gates or other suitable devices.

As shown, FIG. 2 only illustrates a system with two different colors of balls, but the system could accommodate any number of additionally colored balls. All of the balls may be the same size and of the same composition of materials, just different colors. The color of each ball may be determined by an optical system, so the system know which elements to open to store the ball in its respective rack. Different colored balls may also have different material compositions that do not change the performance or operation of the ball but make it possible to differentiate the balls in other ways. For example, each ball may include a unique RFID tag within the ball that can be read by a RFID tag reader. Similarly, each ball may also have a different composition of magnetic material that made it possible to differentiate each color of ball.

A processor (not shown) may control operation of the elements 114, 118, 116 and 120. Upon the random number generator of the processor determining what color of ball is to be dropped in the next roulette wagering event, the processor may direct opening of the appropriate element 114 or 116 so that the air flow 124 entering ball delivery tube 102 moves the selected roulette ball out of the tube 102 in air flow direction 122 to the roulette wheel ball spin component. After a trap door of the wheel opens and a ball enters ball return tube 104, air flow in direction 126 may return the ball to the appropriate open/close elements 118 and 120 for respective storage. Multiple standard balls 112 are shown in storage area 108 as illustrative. As the standard balls are used with greater frequency than the bonus ball, the ability to store multiple balls, especially multiple standard balls can be within the system to reduce frequency of ball replacement in the system.

In general terms with respect to roulette play, in some embodiments, methods of administering games of roulette may involve accepting a wager from a player. A random outcome generation apparatus may be used to randomly generate a number and associated color ball from within a range of numbers and associated colors. Random outcome generation may be performed by a processor configured for that purpose. The processor may be physically connected to the table 208 or located in a remote server accessible over a network. The at least one processor may be programmed to: accept a wager from a player; randomly select a different color ball that may be spun onto the spinning wheel for a payout on the wager; randomly generate a number for the event; resolve wagers by determining the roulette event outcome and the outcome of any side bet wager; authorize payment of a payout to the player, an amount of the payout being equal to an amount of the winning wager multiplied by some amount; and authorize collection of the amount of the wager for the house when no winning outcome occurs with an underlying roulette outcome event.

In embodiments, the acts of the dealer or other operator may be carried out by a visual representation of a dealer, the visual representation being generated and/or displayed by a computer. The visual representation may be a virtual person (e.g., an animation), or may be a transmission (e.g., a video) of an actual person. The visual representation may be part of an online gaming experience of the disclosed game. The acts described in this disclosure associated with a dealer, including randomly generating a number and associated color (e.g., by introducing a ball onto a spinning roulette wheel or by activating an electronic random number generator), accepting or paying bets, or any other actions, may be represented in any way when used in an online environment. For example, the randomly generated numbers and associated colors generated by with a dealer action, described as being produced or otherwise initiated by a dealer, may appear as highlighted spaces on a virtual roulette wheel, as transmitted pictures of playing cards representing results achievable using a conventional physical roulette wheel, or as plain or colored text.

The visual representation may include a display of a virtual roulette wheel where each space on the roulette wheel, with its associated number and color, is displayed to an online player in a manner consistent with the game play disclosed herein but may or may not include a visual representation of a dealer with the roulette wheel. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

Live, electronic, or online implementations of the methods described in this disclosure may be configured for administration as either "play-for-pay" embodiments or "play-for-fun" embodiments. In play-for-pay embodiments, wagers having real-world monetary value are received and payouts having real-world monetary value may be distributed. Play-for-pay embodiments include "house-banked" embodiments and "player-banked" embodiments. In house-banked embodiments, payouts are paid by, and losses are retained by, the game administrator (e.g., a casino or other gaming establishment). Play-for-fun embodiments (e.g., "free play-for-fun" configurations and "socialplay-for-fun" configurations) involve receiving wagers having no real-world monetary value and distribute payouts having no real-world monetary value.

The actions described in this disclosure as the acts of a player, including betting and any other actions, may be carried out over a network where the indicated actions are received as input to a device. The input-receiving device is typically physically remote from the game server or game host and is connected over a long-distance network but may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touch screens, buttons, mice, optical location devices, eye movement/location detectors, sound input devices, etc. When discussing a device, it is understood the device may comprise multiple components and be complex, including hardware components combined with firmware and/or software, and may itself be a subcomponent of a larger system.

In addition to the wheel and ball being controlled by a processor-controlled electromechanical system, the layout of the table and the placing and resolving of bets may be carried out in a computerized system. For example, referring now to FIG. 3, an upright electronic gaming device system 300 is illustrated. The system 300 may or may not be used in connection with a playing surface for implementation of a method of administering a wagering game, according to another embodiment of the present disclosure. The system 300 may be configured for implementation of embodiments of wagering games according to the present disclosure. The individual electronic gaming device 300 may include an individual player position 314 that includes a player input area 332 configured to enable a player to interact with the individual electronic gaming device 300 through various input devices.

The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving a physical wheel, physical ball or live personnel. The action may instead be simulated by a processor 350 operably coupled to the memory 340 and interacting with and controlling the individual electronic gaming device 300. The device 300 may also function as a player terminal to participate in a multi-player game administered by a dealer, the system having a community game outcome determining device, such as a physical roulette wheel with physical balls that are controlled by a processor-controlled electromechanical system.

Figure 3:
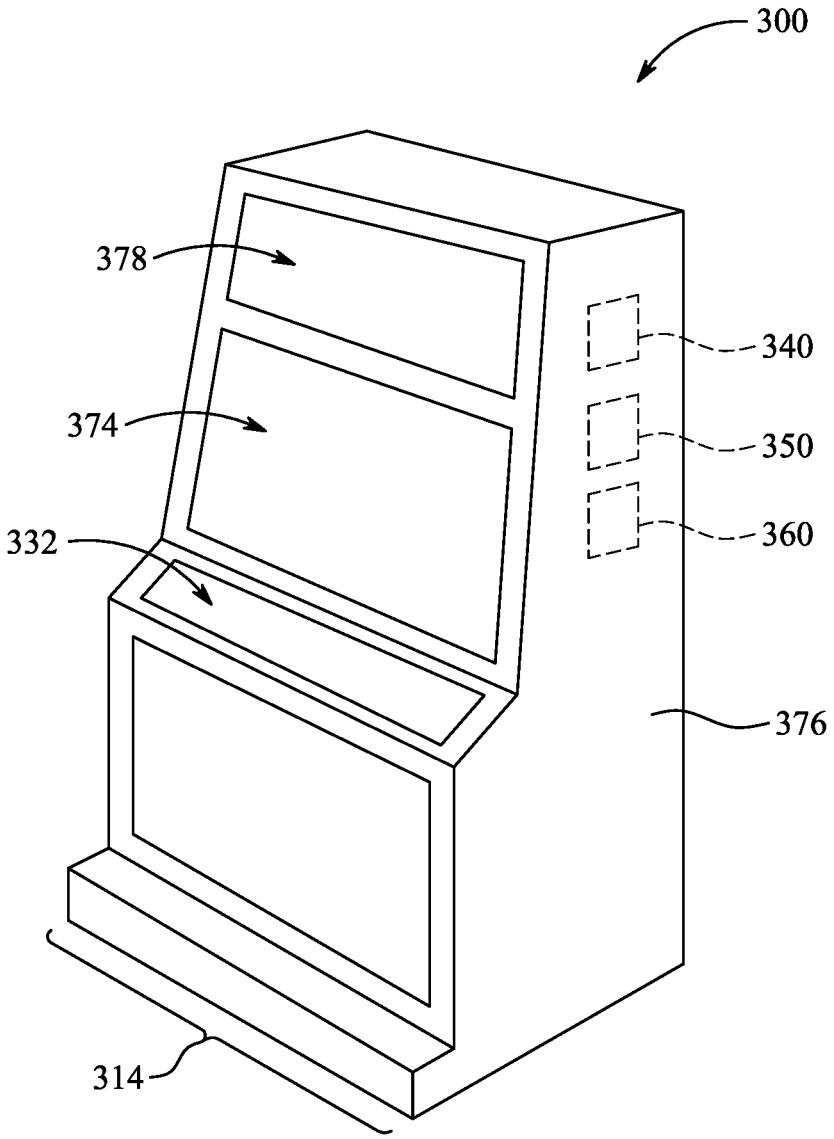
FIG. 3 is a diagram of an upright video display that may be used in connection with a roulette playing surface.

Although device 300 of FIG. 3 has an outline of a traditional gaming cabinet, the individual electronic gaming device 300 may be implemented in any number of ways, including, but not limited to, client software downloaded to a portable device, such as a smart phone, tablet, or laptop personal computer. The individual electronic gaming device 300 may also be a non-portable personal computer (e.g., a desktop or all-in-one computer) or other computing device. In some embodiments, client software is not downloaded but is native to the device or is otherwise delivered with the device when distributed to a player. A communication device 360 may be included and operably coupled to the processor 350 such that information related to operation of the individual gaming device 300, information related to the game play, or combinations thereof may be communicated between the individual gaming device 300 and other devices (not shown) through a suitable communication media, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown), and speakers (not shown) for transmitting and/or receiving sounds during game play. The gaming screen 374 may be in the form of a touch screen.

Figure 4A:
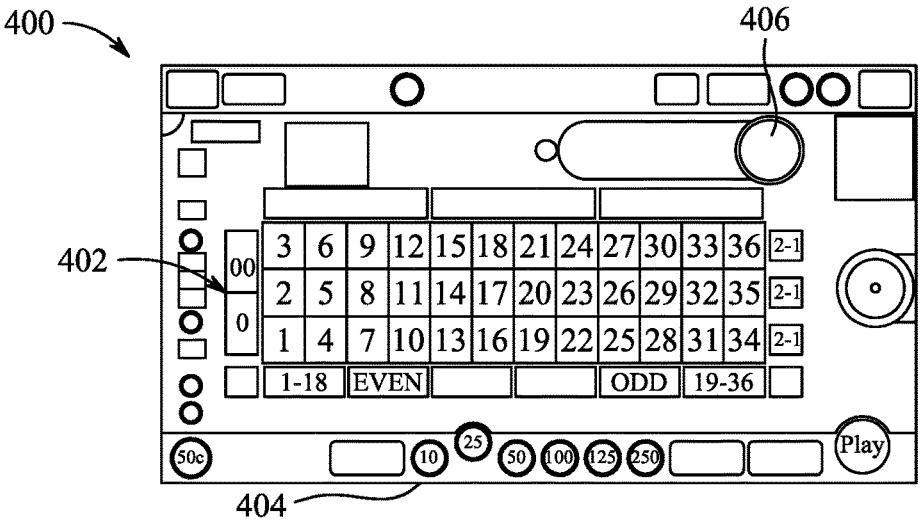
FIG. 4A is an illustration of a user interface of an embodiment displayed on the video display when a side bet is placed.
Figure 4B:
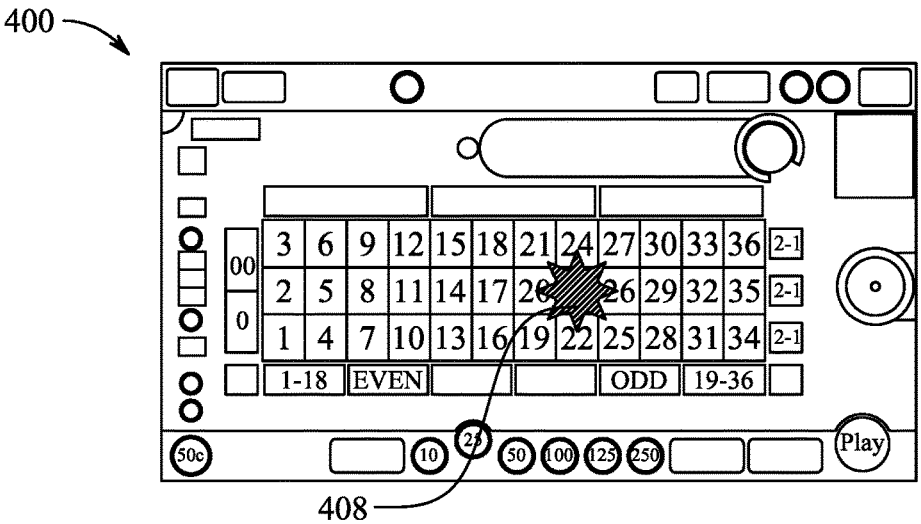
FIG. 4B is an illustration of a user interface of an embodiment displayed on the video display when a standard bet is placed.
Figure 4C:
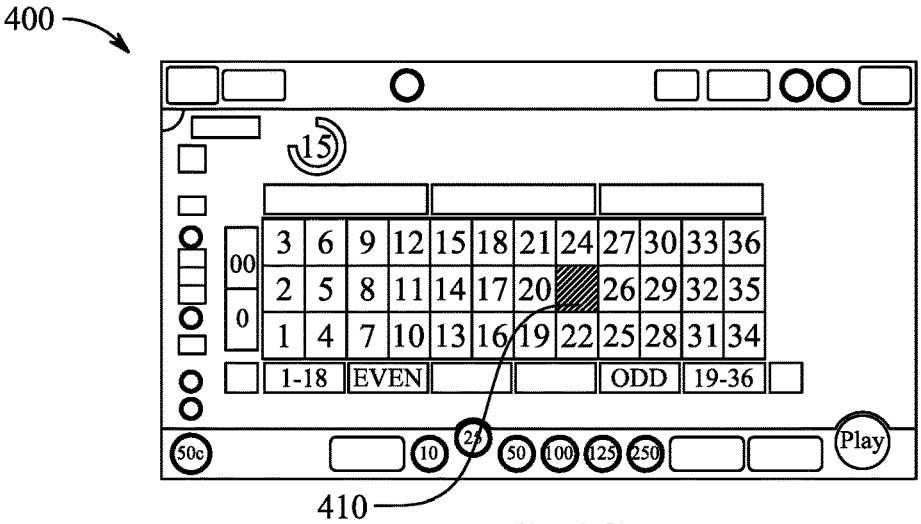
FIG. 4C is an illustration of a user interface of an embodiment displayed on the video display when a lucky number is selected.

As illustrated in FIG. 4A, FIG. 4B and FIG. 4C, the gaming screen 374 may include a display 400 that includes a layout 402 that includes images and text like the layout 304 of the roulette table of FIG. 1 and may or may not include an illustration of the wheel and ball. Additional features include information about the amount of player funds that are available, how much is being bet, how much has been won, etc. A row of chips 404 at the bottom of the display may be configured to allow the player to place a bet by touching a chip and dragging the chip onto the layout 402 to place a bet for the amount of the chip in the same manner as standard roulette. A side bet area 406 may allow the player to place a side bet related to the ball to be spun. The side bet may be placed by touching and dragging a chip from the row of chips 404 to the side bet area 406.

In accordance with an embodiment, if a side bet is placed and a ball of the first color, such as golden colored, is subsequently spun, the player wins. If the golden ball is not spun, then the player loses the side bet and the remainder of the game proceeds according to a standard roulette event. FIG. 4B illustrates one or more standard bets 408 placed on the layout 402 according to a standard roulette event.

In an embodiment, if the side bet is placed and the golden ball is spun and the golden ball settles in a numbered slot matching the player's lucky number, the player wins more. the lucky number may correspond to any of the numbered positions on the layout 402, such as 0 to 36. The lucky number may not be the same as any number corresponding to a player's standard bet. The lucky number may be automatically generated and displayed on the layout 402 as shown by the golden ball chip 410 of FIG. 4C. The lucky number may be determined based on the first straight or single bet placed by a player during an event. A straight or single bet is a bet where a player has placed a bet only on a specific single number. If only combination bets are placed by the players, such as split bets, street bets, corner bets, outside bets, etc., then the lucky number may be selected randomly. A player may change the lucky number once selected as long as the event is still open for betting. The player may also continue to bet on the standard roulette event regardless of the lucky number and all standard bets would be paid according to the standard pay table.

Figure 5A:
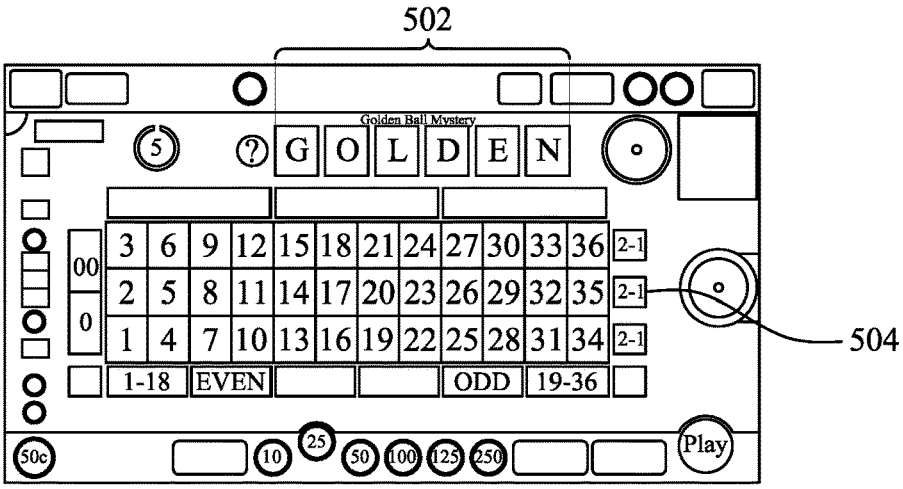
FIG. 5A is an illustration of a user interface of an embodiment displayed on the video display when a side bet is placed.
Figure 5B:
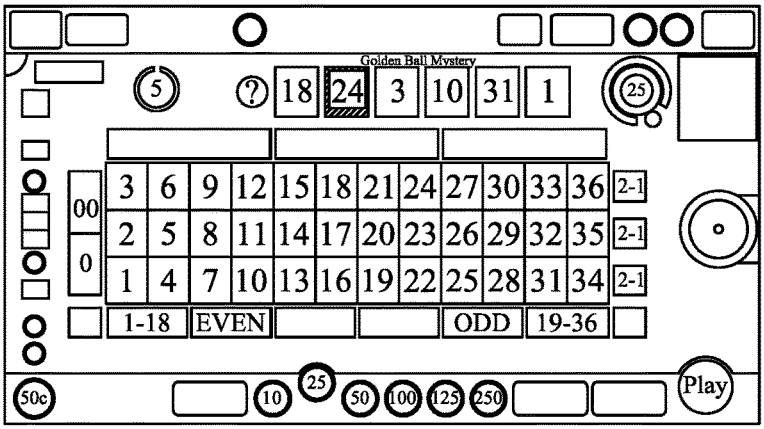
FIG. 5B is an illustration of a user interface of an embodiment displayed on the video display when lucky numbers are revealed.
Figure 5C:
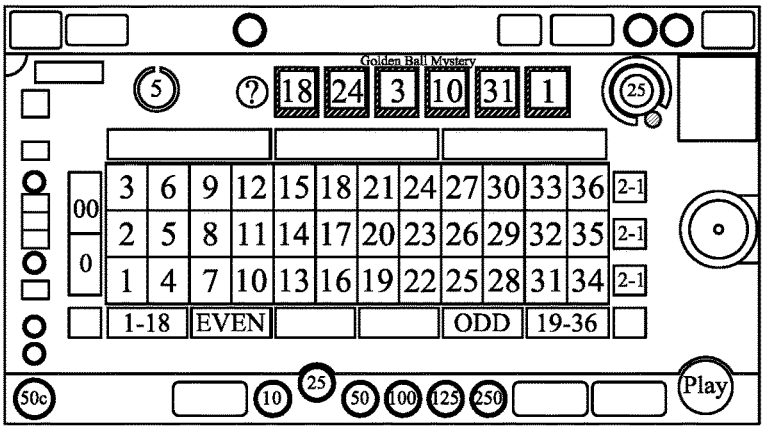
FIG. 5C is an illustration of a user interface of an embodiment displayed on the video display when a second color ball is spun.

In an embodiment, a plurality of lucky numbers may be selected for each roulette event when a side bet has been placed. As shown in FIG. 5A, the plurality of numbers 502 above the layout 504 may initially be covered and remain covered until a betting period for the event has passed, at which point the lucky numbers may be revealed, as in FIG. 5B, which may be done through an animation sequence. Once all of the numbers have been revealed, a second animation sequence may be utilized to reveal the odds associated with each of the numbers, as in FIG. 5C where the odds are illustrated below each lucky number. For example, all of the numbers may initially have the same odds, but one of the numbers may be randomly selected to have higher odds. If the white ball is then spun instead of the golden ball and the numbered slot in which the ball settles matches one of the lucky numbers, then the player wins the side bet. The odds paid to the player for a win depends on the odds randomly selected for the lucky numbers, i.e., only one of six pays the higher odds.

If the golden ball is spun, however, and the numbered slot in which the ball settles matches one of the lucky numbers, then the player wins the side bet. The odds paid to the player for a win depends on the odds randomly selected for the lucky numbers, but in this embodiment, there are a plurality of odds, such as OddA, OddB, OddC and OddD. OddA may be the same as regular odds regardless of the ball color and OddB may be same as bonus odds regardless of the ball color, but OddC may be regular odds for a golden ball in case a golden ball is spun and OddD may be bonus odds for a golden ball in case a golden ball is spun. For example, if the odds for OddA were 2, OddB were 4, OddC were 6 and OddD were 8, a white ball was spun, and the numbered slot in which the ball settles matches one of the lucky numbers, then the player wins the side bet and the odds paid are either 2 or 4, with only one lucky number paying 2 odds. If the golden ball was spun, and the numbered slot in which the ball settles matches one of the lucky numbers, then the player wins the side bet and the odds paid are either 2, 4, 6 or 8, depending on the randomly determined odds of the lucky number.

In an embodiment a plurality of lucky numbers are selected, but if the white ball is spun, the player loses the side bet. If the golden ball is spun, however, and the numbered slot in which the ball settles matched one of the lucky numbers, then the player wins the side bet based on the four different odds selected for the lucky numbers.

Conditional language used herein, such as, among others, "can," "could," "might," "may," "e.g." and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having" and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some or all of the elements in the list.

While certain example embodiments have been described, these embodiments have been presented by way of example only and are not intended to limit the scope of the disclosure. Thus, nothing in the foregoing description is intended to imply that any particular feature, characteristic, step, module or block is necessary or indispensable. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of certain of the disclosure.

What is claimed is:

1. A method of resolving side bet wagers within a wagering system, comprising:

storing a first color roulette ball in a first area of a roulette ball storage area and storing a second color roulette ball in a second area of the roulette ball storage area;

selecting with a selection system either the first color roulette ball or the second color roulette ball to use in a roulette wagering event in which a roulette wheel is spun and the selected roulette ball is delivered onto a track on the spinning roulette wheel to determine an outcome of the roulette wagering event when the selected roulette ball stops at a numbered position on the roulette wheel;

with a processor having a random number generator causing the selection system to randomly select either the first color roulette ball or the second color roulette ball for use as the selected roulette ball;

with the processor selecting a side bet number when a side bet is placed by a player;

with the processor recognizing wagers on the outcome of the roulette wagering event and wagers on an outcome of the side bet placed during a period of the roulette wagering event; and with the processor resolving the wagers on the outcome of the side bet at conclusion of the roulette wagering event, wherein:

the wagers on the outcome of the side bet are won and resolved at a first amount equal to each wager when the first color roulette ball is the selected roulette ball;

the wagers on the outcome of the side bet are lost when the second color roulette ball is the selected roulette ball;

the wagers on the outcome of the side bet are won and resolved at a second amount higher than the first amount when the first color roulette ball is the selected roulette ball and the number position on the roulette wheel matches the side bet number; and the wagers on the outcome of the side bet are won and resolved at a third amount when the second color roulette ball is the selected roulette ball and the number position on the roulette wheel matches the side bet number, with the processor, selecting a plurality of additional side bet numbers when a side bet is placed by a player; and with the processor, selecting first odds for the second amount or the third amount for all of the plurality additional side bet numbers except for a first additional side bet number and second odds for the first additional side bet number, the second odds being higher than the first odds;

wherein the wagers on the outcome of the side bet are won and resolved at the first odds or the second odds of the second amount when the first color roulette ball is the selected roulette ball and the number position on the roulette wheel matches one of the plurality of additional side bet numbers; and wherein the wagers on the outcome of the side bet are won and resolved at the first odds or the second odds of the third amount when the second color roulette ball is the selected roulette ball and the number position on the roulette wheel matches one of the plurality of additional side bet numbers.

2. The method of claim 1, wherein the side bet number is selected based on a straight bet placed on a numbered position prior to conclusion of the period.

3. The method of claim 2, further comprising with the processor, enabling the player to change the side bet number after the side bet number is selected and prior to conclusion of the period.

4. The method of claim 1, further comprising with the processor, randomly selecting the side bet number prior to conclusion of the period.

5. The method of claim 4, further comprising with the processor, enabling the player to change the side bet number after the side bet number is selected and prior to conclusion of the period.

6. A method of resolving side bet wagers within a wagering system, comprising:

storing a first color roulette ball in a first area of a roulette ball storage area and storing a second color roulette ball in a second area of the roulette ball storage area;

selecting with a selection system either the first color roulette ball or the second color roulette ball to use in a roulette wagering event in which a roulette wheel is spun and the selected roulette ball is delivered onto a track on the spinning roulette wheel to determine an outcome of the roulette wagering event when the selected roulette ball stops at a numbered position on the roulette wheel;

with a processor having a random number generator causing the selection system to randomly select either the first color roulette ball or the second color roulette ball for use as the selected roulette ball;

with the processor selecting a side bet number when a side bet is placed by a player;

with the processor recognizing wagers on the outcome of the roulette wagering event and wagers on an outcome of the side bet placed during a period of the roulette wagering event; and with the processor resolving the wagers on the outcome of the side bet at conclusion of the roulette wagering event, wherein:

the wagers on the outcome of the side bet are won and resolved at a first amount equal to each wager when the first color roulette ball is the selected roulette ball;

the wagers on the outcome of the side bet are lost when the second color roulette ball is the selected roulette ball;

the wagers on the outcome of the side bet are won and resolved at a second amount higher than the first amount when the first color roulette ball is the selected roulette ball and the number position on the roulette wheel matches the side bet number; and the wagers on the outcome of the side bet are won and resolved at a third amount when the second color roulette ball is the selected roulette ball and the number position on the roulette wheel matches the side bet number, with the processor, selecting a plurality of additional side bet numbers when a side bet is placed by a player; and with the processor, selecting first odds for the second amount or the third amount for a first set of the plurality additional side bet numbers and second odds for the second amount or the third amount for a second set of the additional side bet numbers;

wherein the wagers on the outcome of the side bet are won and resolved at the first odds or the second odds of the second amount when the first color roulette ball is the selected roulette ball and the number position on the roulette wheel matches one of the first set of the plurality of additional side bet numbers; and wherein the wagers on the outcome of the side bet are won and resolved at the first odds or the second odds of the third amount when the second color roulette ball is the selected roulette ball and the number position on the roulette wheel matches one of the second set of the plurality of additional side bet numbers.

7. A method of resolving side bet wagers within a wagering system, comprising:

storing a first color roulette ball in a first area of a roulette ball storage area and storing a second color roulette ball in a second area of the roulette ball storage area;

selecting with a selection system either the first color roulette ball or the second color roulette ball to use in a roulette wagering event in which a roulette wheel is spun and the selected roulette ball is delivered onto a track on the spinning roulette wheel to determine an outcome of the roulette wagering event when the selected roulette ball stops at a numbered position on the roulette wheel;

with a processor having a random number generator causing the selection system to randomly select the first color roulette ball or the second color roulette ball as the selected roulette ball;

with the processor selecting a plurality of side bet numbers when a side bet is placed by a player;

with the processor recognizing a wager on the outcome of the roulette wagering event and a wager on the side bet placed during a period of the roulette wager event; and with the processor resolving the side bet wager at a conclusion of the roulette wagering event, wherein:

the wager on the side bet is resolved at first odds for one set of side bet numbers among the plurality of side bet numbers and second odds for at least one side bet number among the plurality of side bet numbers not among the one set of side bet numbers, the second odds being higher than the first odds, when the second color roulette ball is the selected roulette ball and the number position on the roulette wheel matches one side bet number among the plurality of side bet numbers;

the wager on the side bet is resolved at first odds for one set of side bet numbers among the plurality of side bet numbers, second odds for at least a first side bet number among the plurality of side bet numbers not among the one set of side bet numbers, third odds for at least a second side bet number among the plurality of side bet numbers not among the one set of side bet numbers, and fourth odds for at least a third side bet number among the plurality of side bet numbers not among the one set of side bet numbers, the second odds being higher than the first odds, the third odds being higher than the second odds, the fourth odds being higher than the third odds, when the first color roulette ball is the selected roulette ball and the number position on the roulette wheel matches one side bet number among the plurality of side bet numbers; and the wager on the side bet is forfeit when either the first roulette ball or the second color roulette ball is the selected roulette ball and the number position on the roulette wheel does not match any side bet number among the plurality of side bet numbers.

8. The method of claim 7, further comprising not displaying the plurality of side bet numbers on a display associated with the wagering system until after the period but before conclusion of the roulette wagering event.

9. The method of claim 8, further comprising displaying the plurality of side bet numbers at conclusion of a first animation sequence.

10. The method of claim 9, further comprising not displaying the first odds, the second odds, the third odds and the fourth odds on a display associated with the wagering system until after the plurality of side bet numbers are displayed.

11. The method of claim 9, further comprising displaying the first odds, the second odds, the third odds and the fourth odds at conclusion of a second animation sequence.

* * * * *